US012742589B2

(12) United States Patent
Zhang et al.

(10) Patent No.: US 12,742,589 B2
(45) Date of Patent: Sep. 22, 2026

(54) CLOSED LOOP LNG PROCESS FOR A FEED GAS WITH NITROGEN

(71) Applicant: ConocoPhillips Company, Houston, TX (US)

(72) Inventors: Ying Zhang, Houston, TX (US); Qi Ma, Houston, TX (US); Wesley R. Qualls, Houston, TX (US); Will T. James, Houston, TX (US); Jinghua Chan, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 361 days.

(21) Appl. No.: 18/199,549

(22) Filed: May 19, 2023

(65) Prior Publication Data

US 2023/0375261 A1 Nov. 23, 2023

Related U.S. Application Data

(60) Provisional application No. 63/343,872, filed on May 19, 2022.

(51) Int. Cl.
*F25J 1/00* (2006.01)

(52) U.S. Cl.
CPC ..... *F25J 1/0055* (2013.01); *F25J 1/0022* (2013.01); *F25J 1/004* (2013.01); *F25J 2220/62* (2013.01)

(58) Field of Classification Search
CPC ..... F25J 1/0055; F25J 1/0022; F25J 1/004; F25J 2220/62; F25J 1/0207; F25J 2200/02; F25J 2200/40; F25J 2200/50; F25J 2200/74; F25J 2205/04; F25J 2215/04; F25J 2230/60; F25J 2245/02; F25J 2260/20; F25J 2270/12; F25J 2270/60; F25J 1/0082; F25J 1/0087; F25J 1/0238; F25J 3/0209;
(Continued)

(56) References Cited

U.S. PATENT DOCUMENTS 3,254,496 A 6/1966 Bernard et al.
5,651,270 A 7/1997 Low et al.
(Continued)

FOREIGN PATENT DOCUMENTS

OA 12269 A * 5/2006 ..... F25J 1/0231

OTHER PUBLICATIONS

International Search Report and The Written Opinion of The International Searching Authority for International Application No. PCT/US 23/22853 dated Sep. 29, 2023 (12 pages).
(Continued)

*Primary Examiner* — Joel M Attey
*Assistant Examiner* — Brahim A. Michael Adeniji
(74) *Attorney, Agent, or Firm* — Polsinelli PC

(57) ABSTRACT

Systems and methods for processing liquefied natural gas (LNG) can include an LNG production system with a methane refrigeration cycle downstream from an ethylene refrigeration cycle. The methane refrigeration cycle can be a closed loop methane refrigeration cycle that maintains a methane refrigerant separate from a natural gas feed, (e.g., compared to an open loop methane refrigeration cycle that extracts the methane refrigerant from the natural gas feed and recombines the methane refrigerant with the natural gas feed). The natural gas feed can be a medium or high nitrogen gas feed having a nitrogen content greater than 1.0% molarity.

10 Claims, 5 Drawing Sheets

(58) Field of Classification Search
CPC ..... F25J 1/0052; F25J 1/0085; F25J 1/021; F25J 1/0265; F25J 3/0233; F25J 3/0257
See application file for complete search history.

(56) References Cited

U.S. PATENT DOCUMENTS

| | | | | |
|---|---|---|---|---|
| 6,662,589 | B1 | 12/2003 | Roberts et al. | |
| 10,612,842 | B2 | 4/2020 | Guerif et al. | |
| 10,866,022 | B2 | 12/2020 | Krishnamurthy et al. | |
| 11,079,176 | B2 | 8/2021 | Pierre, Jr. | |
| 2014/0238076 | A1 | 8/2014 | Qualls et al. | |
| 2014/0260417 | A1* | 9/2014 | Herzog | F25J 3/0233 62/611 |
| 2015/0260451 | A1 | 9/2015 | Haberberger et al. | |
| 2015/0308738 | A1* | 10/2015 | Ott | F25J 1/0212 62/623 |
| 2016/0298899 | A1 | 10/2016 | James | |
| 2018/0231303 | A1 | 8/2018 | Pierre, Jr. | |
| 2020/0056836 | A1 | 2/2020 | Roberts et al. | |
| 2020/0386474 | A1 | 12/2020 | Chan et al. | |
| 2021/0140710 | A1* | 5/2021 | James | F25J 1/004 |

OTHER PUBLICATIONS

Arnaiz Del Pozo Carlos et al: "Efficiency evaluation of closed and open cycle purerefrigerant cascade natural gas liquefaction process through exergy analysis", Journal of Natural Gas Science and Engineering, vol. 89, May 1, 2021 (May 1, 2021), p. 103868, XP055803708.

Extended European Search Report for Application No. 23808350.5 dated May 8, 2026 (9 pages).

* cited by examiner

CLOSED LOOP LNG PROCESS FOR A FEED GAS WITH NITROGEN

CROSS-REFERENCE TO RELATED APPLICATION

This application claims priority to U.S. Provisional Patent Application No. 63/343,872, filed May 19, 2022 and titled "CLOSED LOOP LNG PROCESS FOR A FEED GAS WITH NITROGEN, the entirety of which is incorporated by reference herein.

FIELD

Aspects the present disclosure relate generally to systems and methods for liquefaction of natural gas and more particularly to a methane refrigerant-based cooling process.

BACKGROUND

Natural gas is a commonly used resource comprised of a mixture of naturally occurring hydrocarbon gases typically found in deep underground natural rock formations or other hydrocarbon reservoirs. More particularly, natural gas is primarily comprised of methane and often includes other components, such as, ethane, propane, carbon dioxide, nitrogen, hydrogen sulfide, and/or the like.

Cryogenic liquefaction generally converts the natural gas into a convenient form for transportation and storage. More particularly, under standard atmospheric conditions, natural gas exists in vapor phase and is subjected to certain thermodynamic processes to produce liquified natural gas (LNG). Liquefying natural gas greatly reduces its specific volume, such that large quantities of natural gas can be economically transported and stored in liquefied form.

Some of the thermodynamic processes generally utilized to produce LNG involve cooling the natural gas to near atmospheric vapor pressure. For example, a natural gas stream may be sequentially passed at an elevated pressure through multiple cooling stages that cool the gas to successively lower temperatures until the liquefaction temperature is reached. Stated differently, the natural gas stream is cooled through indirect heat exchange with one or more refrigerants, such as propane, propylene, ethane, ethylene, methane, nitrogen, carbon dioxide, and/or the like, and expanded to near atmospheric pressure.

However, preventing components lighter than methane (e.g., nitrogen, hydrogen, helium, and/or argon) from accumulating in the refrigerant recycle stream can be difficult for open loop methane processes. Accumulation of these lighter components in the refrigerant stream can increase the compression power needed for the refrigerant compressor, which decreases the efficiency of the system.

It is with these observations in mind, among others, that various aspects of the present disclosure were conceived and developed.

SUMMARY

Implementations described and claimed herein address the foregoing problems by providing systems and methods for cooling a natural gas feed with a closed loop methane refrigeration cycle. The method can include receiving the natural gas feed from an ethylene chiller of a cascading liquified natural gas (LNG) process; subcooling the natural gas feed by indirect heat exchange with a methane refrigerant at one or more methane refrigerant heat exchangers to form a subcooled natural gas feed; reducing a pressure of the subcooled natural gas feed through an expansion device; separating a two phase stream, resulting from reducing the pressure, in an end flash vessel; and/or outputting an LNG product as a liquid fraction from the end flash vessel.

In some examples, the natural gas feed has a nitrogen content greater than 1.0 percent molarity and lower than 2.5 percent molarity. The method can also include condensing a methane refrigerant discharge in an ethylene heat exchanger to form a condensed methane refrigerant that is sent to the one or more methane refrigerant heat exchangers. Additionally, the method can include expanding the methane refrigerant discharge to a lower pressure prior to cooling the LNG product with the methane refrigerant discharge. The ethylene heat exchanger and/or the one or more methane refrigerant heat exchangers can be a core-in-shell heat exchanger. Cooling the LNG product with the one or more methane refrigerant heat exchangers is a sub-cooling step of the cascading LNG process that substitutes combining a methane outlet stream from a methane economizer with the natural gas feed. Cooling the LNG product with the methane refrigerant discharge can also omit a nitrogen removal unit downstream from the ethylene chiller. Additionally or alternatively, the method can include compressing a vapor stream from the end flash vessel to form a compressed vapor stream. The method can also include sending part of compressed vapor stream from the end flash vessel to be used as fuel, and/or the ethylene chiller can be a core-in-shell heat exchanger.

In some instances, a system for cooling a natural gas feed with a closed loop methane refrigeration cycle can include one or more methane refrigerant heat exchangers to subcool the natural gas feed by indirect heat exchange with a methane refrigerant at methane refrigerant heat to form a subcooled natural gas feed; an expansion device to reduce a pressure of the subcooled natural gas feed; and/or an end vessel to separate the subcooled natural gas feed a two phase stream, resulting from reducing the pressure, in an end flash vessel, and output an LNG product as a liquid fraction from the end flash vessel.

In some examples, the system can also include an ethylene chiller to send the natural gas feed of a cascading liquified natural gas (LNG) process to the one or more methane refrigerant heat exchangers. The system can also include a low stage ethylene chiller and condenser unit of a cascading LNG process to operate as the ethylene chiller and an ethylene heat exchanger. Additionally, the system can include a single Nitrogen Removal Unit (NRU) column for providing high purity methane into the closed loop methane refrigeration cycle from a bottom outlet of the NRU column. Also, the system can include a compressed vapor steam formed by the end flash vessel. Moreover, the system can include an ethylene heat exchanger to condense a methane refrigerant discharge to form a condensed methane refrigerant that is sent to the one or more methane refrigerant heat exchangers. The system can include a methane economizer with a methane outlet stream such that cooling the LNG product with the one or more methane refrigerant heat exchangers is a sub-cooling step of a cascading LNG process that substitutes combining the methane outlet stream with the natural gas feed. The system can include a nitrogen content of the natural gas feed greater than 2.5 percent molarity.

In some instances, a system for cooling a natural gas feed with a closed loop methane refrigeration cycle can include one or more methane refrigerant heat exchangers to subcool the natural gas feed by indirect heat exchange with a methane refrigerant to form a subcooled natural gas feed; an expansion device to reduce a pressure of the subcooled natural gas feed; and/or an end vessel to separate the subcooled natural gas feed a two phase stream, resulting from reducing the pressure, in an end flash vessel, and output an LNG product as a liquid fraction from the end flash vessel.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
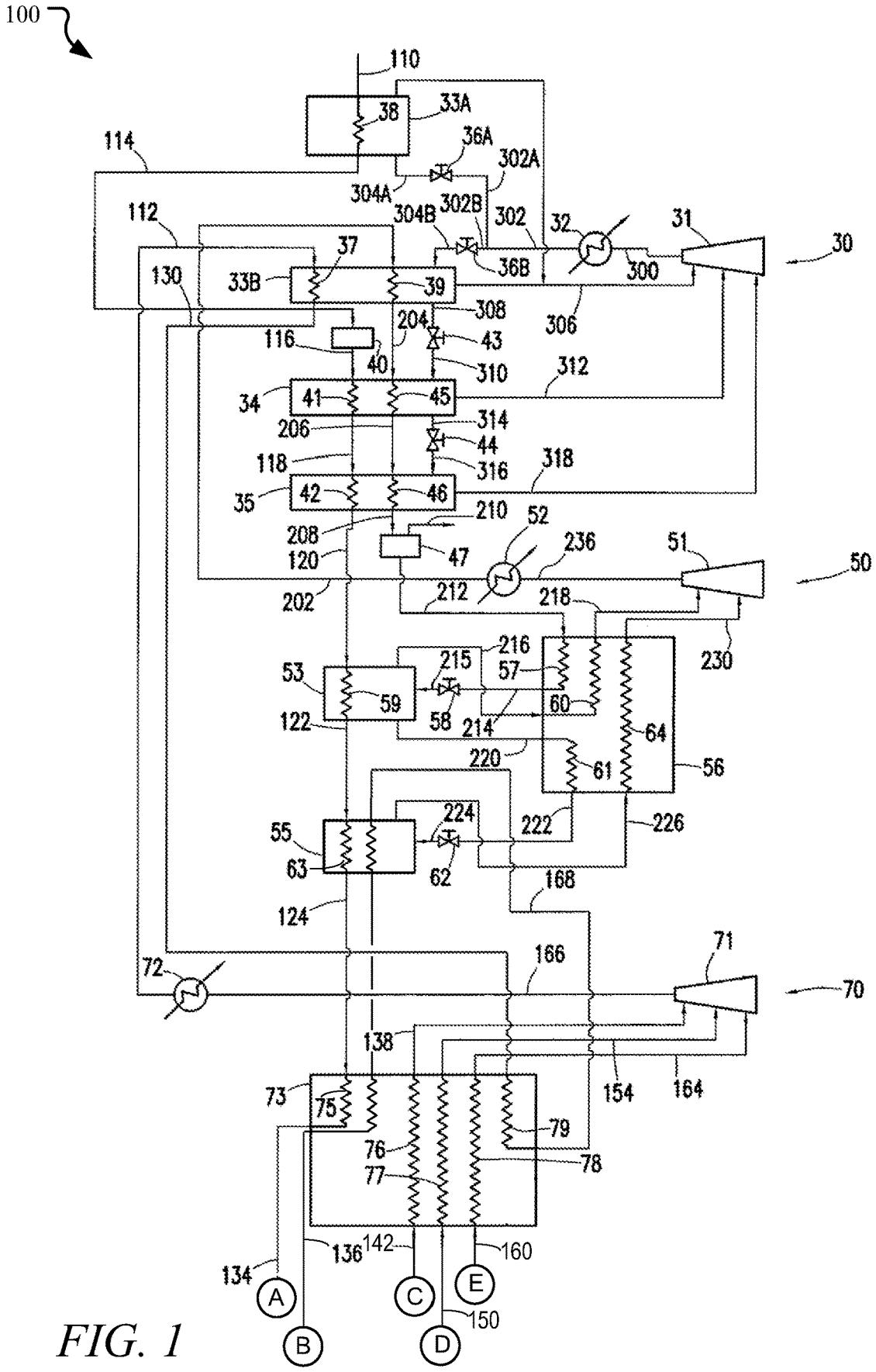
FIG. 1 illustrates an example LNG production system including a cascade refrigeration process for cooling a feed gas during LNG production.

Aspects of the present disclosure involve systems and methods for LNG processing using a closed loop methane refrigeration cycle to resolve issues arising from an open loop methane refrigeration cycle. In the open loop methane refrigeration cycle, the predominately methane refrigerant is derived from the natural gas feed undergoing liquefaction, and at least part of the predominately methane refrigerant is recombined with the natural gas undergoing liquefaction. However, due to multiple stage flashes in the open loop methane refrigeration cycle, the components lighter than methane (e.g., nitrogen, hydrogen, helium, argon, and the like) accumulate in the methane refrigerant recycle stream. When the feed gas has a nitrogen content of 0.5% molarity, the methane compressor discharge stream of the open loop methane refrigeration cycle can have a nitrogen content that is more than 10 times higher than the nitrogen content of the feed gas. This nitrogen concentration increase in the open loop methane refrigeration system results in an in increase in the compression power requirements to compress the methane refrigerant. This results in a decrease in LNG production for the selected gas turbines. Sensitivity to the presence of nitrogen in the feed gas stream reveals a detrimental effect on the performance of the open loop process.

To address this issue, the systems disclosed herein include a closed loop cascade process operating with a closed loop methane refrigeration cycle. This system can be deployed for cooling a feed gas with a medium nitrogen content (e.g., up to 2.5% by mole) and/or a high nitrogen content (e.g., greater than 2.5% by mole). The system improves the process efficiency of processing a medium or high nitrogen feed gas and can eliminate or reduce the usage of nitrogen removal unit components.

The system disclosed herein can receive the high nitrogen natural gas feed received from an ethylene chiller and can further subcool the high nitrogen feed gas at high pressure. For instance, the high nitrogen feed gas can be subcooled by indirect heat exchange with methane refrigerant at methane refrigerant heat exchangers. The subcooled feed gas can be let down to a lower pressure and the resulting two phase stream can be separated in an end flash vessel. A vapor stream exiting the end flash vessel can be further compressed and a part of the compressed gas can be used as fuel. The liquid fraction from the end flash vessel can be the LNG product. Methane refrigerant discharged from a methane compressor can be condensed in an ethylene exchanger, such as a low stage ethylene exchanger/chiller of an ethylene refrigeration cycle upstream from the methane refrigeration cycle. The methane refrigerant can be expanded to high pressure (HP), medium pressure (MP), and/or low pressure (LP) pressure levels to provide refrigeration for the last remaining sub-cooling steps of the natural gas feed. Accordingly, in the closed loop methane refrigeration cycle, the natural gas feed is kept separate from the methane refrigerant such that the methane refrigerant does not combine with the natural gas feed during this cooling step. The system can process a medium nitrogen feed gas without the need for nitrogen removal unit, and/or a high nitrogen feed gas using a smaller nitrogen unit with less components than those used in open loop cooling cycles. Thus the presently disclosed technology can eliminate or reduce the accumulation of nitrogen in the methane cooling cycle for medium or high nitrogen feed gases (e.g., by omitting a step of mixing the methane refrigerant with the feed gas), reduce refrigerant compression power requirements, and increase the efficiency of the LNG process resulting in increased production output. Other advantages will be apparent from the present disclosure.

I. Terminology

The liquefaction process described herein may incorporate one or more of several types of cooling systems and methods including, but not limited to, indirect heat exchange, vaporization, and/or expansion or pressure reduction.

Indirect heat exchange, as used herein, refers to a process involving a cooler stream cooling a substance without actual physical contact between the cooler stream and the substance to be cooled. Specific examples of indirect heat exchange include, but are not limited to, heat exchange undergone in a shell-and-tube heat exchanger, a core-in-shell heat exchanger, a spiral wound heat exchanger, a printed circuit heat exchanger and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some implementations, expansion means may be through an expansion valve. In other implementations, the expansion means may be either a liquid, two-phase or gas expander. Expanders recover work energy from the expansion process and achieve lower process stream temperatures upon expansion.

In the description, phraseology and terminology are employed for the purpose of description and should not be regarded as limiting. For example, the use of a singular term, such as "a", is not intended as limiting of the number of items. Also, the use of relational terms such as, but not limited to, "down" and "up" or "downstream" and "upstream", are used in the description for clarity in specific reference to the FIGS. and are not intended to be limiting in scope. Further, any one of the features may be used separately or in combination with any other feature. For example, references to the term "implementation" means that the feature or features being referred to are included in at least one aspect of the disclosed subject matter. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the disclosed subject matter may include a variety of combinations and/or integrations of the implementations described herein. Additionally, all aspects of the disclosed subject matter as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

Some LNG projects introduce pipelines as a source of feed gas in an LNG Optimized Cascade Process (OCP). The OCP is based on three multi-staged, cascading refrigerant circuits using essentially pure refrigerants, brazed aluminum heat exchangers and insulated cold box modules. Essentially pure refrigerants of propane (or propylene), ethylene, and methane may be utilized.

The presently disclosed technology may be implemented in a cascade LNG system employing a cascade-type refrigeration process using one or more predominately pure component refrigerants. The refrigerants utilized in cascade-type refrigeration processes can have successively lower boiling points to facilitate heat removal from the natural gas stream that is being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

In one implementation, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may include a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising three different refrigerants in three separate refrigeration cycles is made, this is not intended to be limiting. It is recognized that a cascade LNG process involving any number of refrigerants and/or refrigeration cycles may be compatible with one or more implementations of the presently disclosed technology. Other variations to the cascade LNG process are also contemplated. It will also be appreciated that the presently disclosed technology may be utilized in non-cascade LNG processes. One example of a non-cascade LNG process involves a mixed refrigerant LNG process that employs a combination of two or more refrigerants to cool the natural gas stream in at least one cooling cycle.

In some instances, the third refrigeration of the Optimized Cascade Process (OCP) is a methane refrigerant cooling cycle, which can be an open methane cooling cycle (e.g., in which the flashed vapors of the refrigerant are recompressed and recycled into the natural gas feed) or a closed methane cooling cycle (e.g., in which the refrigerant is maintained separate from the natural gas feed). In some conditions, the closed loop methane refrigerant system can be used to lower the temperature of the natural gas feed with a medium nitrogen content (e.g., between 0.5% and 2.5% molarity) or a high nitrogen content (e.g., greater than 2.5% molarity) which can be received from the low-stage ethylene chiller/condenser 55. The closed loop system can subcool the high or medium nitrogen natural gas feed(s) using the techniques disclosed herein to reduce the power requirements or specific power value calculations of the methane cooling cycle of the OCP operated by the LNG facility 100 (e.g., by removing the need for a nitrogen removal unit (NRU)).

Furthermore, in some examples, the closed loop methane process can include an NRU and/or components of the NRU. However, some examples discussed herein may omit the NRU, or reduce the NRU size or number of NRU components.

Figure 2:
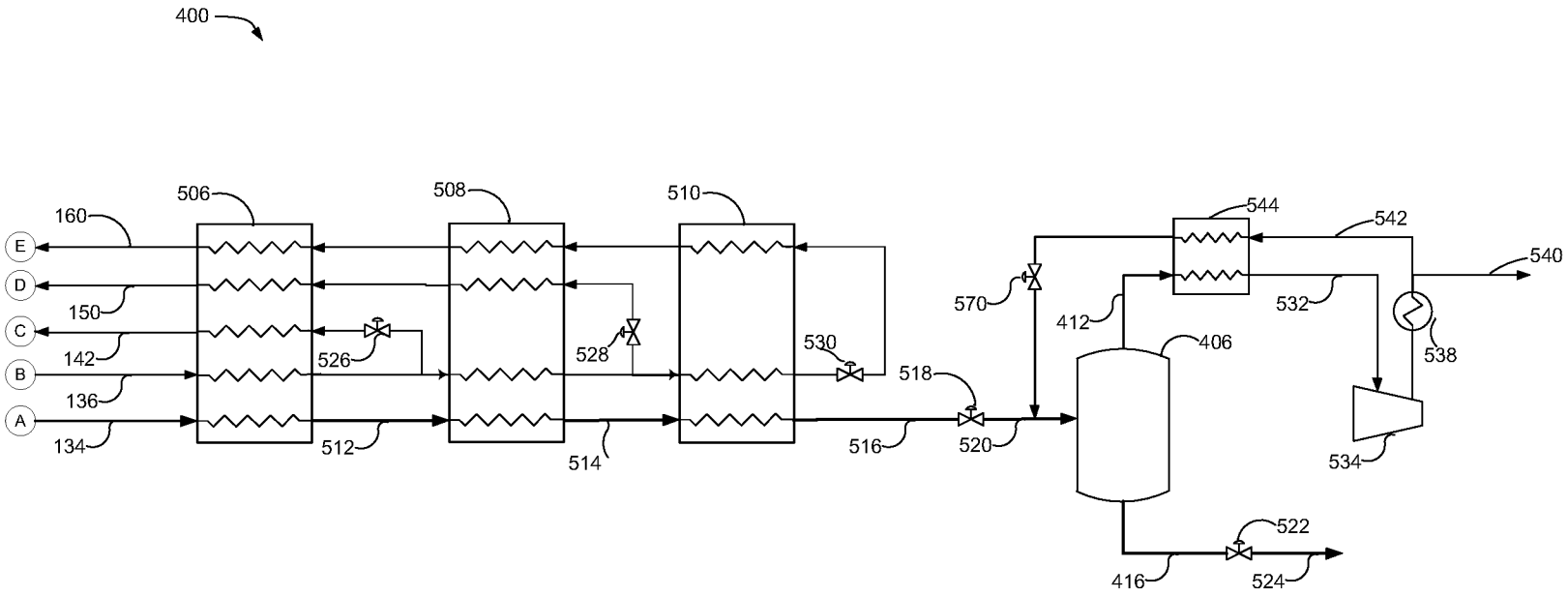
FIG. 2 illustrates an example LNG production system including a closed loop methane refrigeration cycle without nitrogen removal, which can form at least a portion of the LNG production system depicted in FIG. 1.
Figure 3:
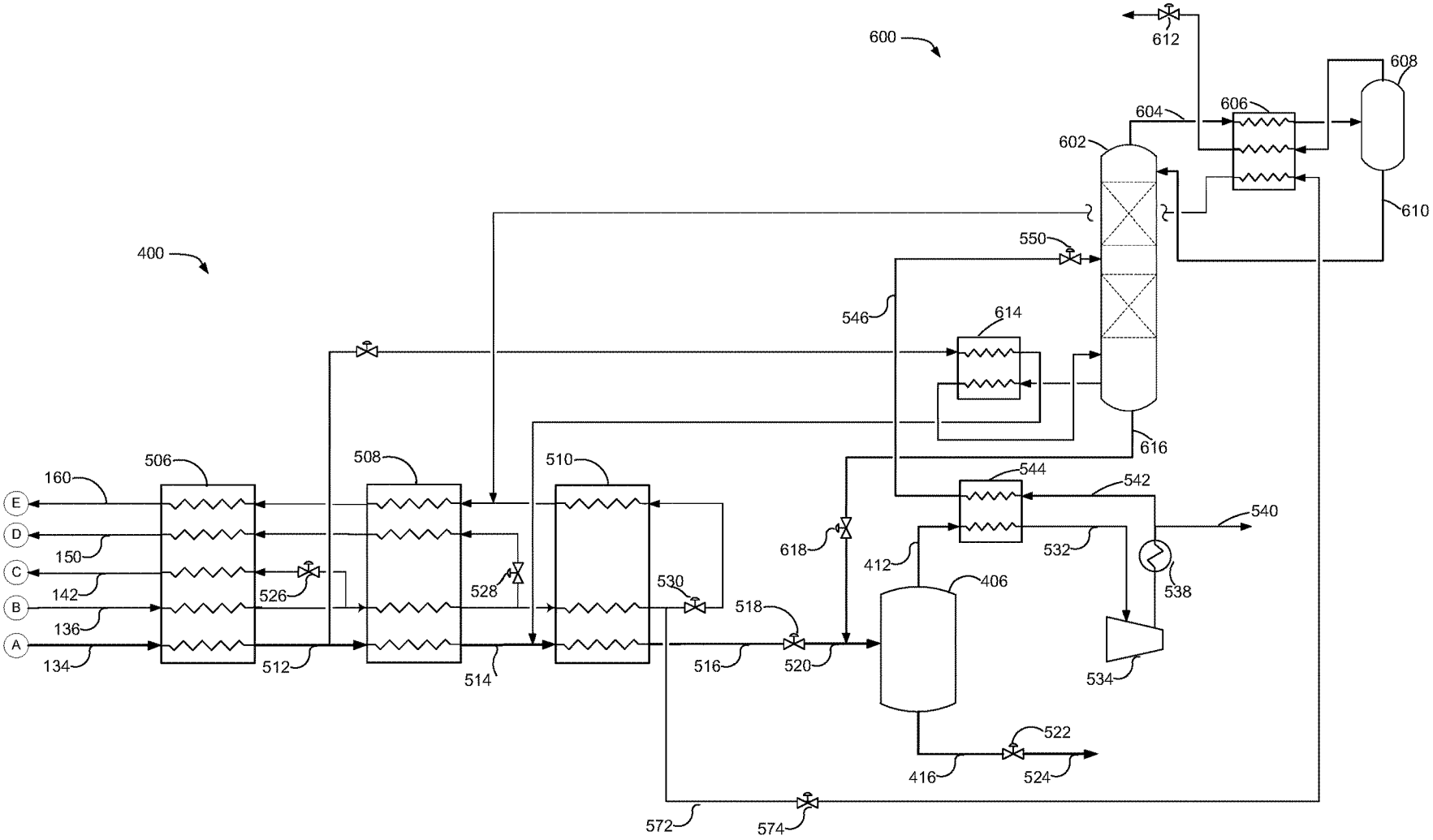
FIG. 3 illustrates an example LNG production system including a closed loop methane refrigeration cycle with nitrogen removal, which can form at least a portion of the LNG production system depicted in FIG. 1.
Figure 4:
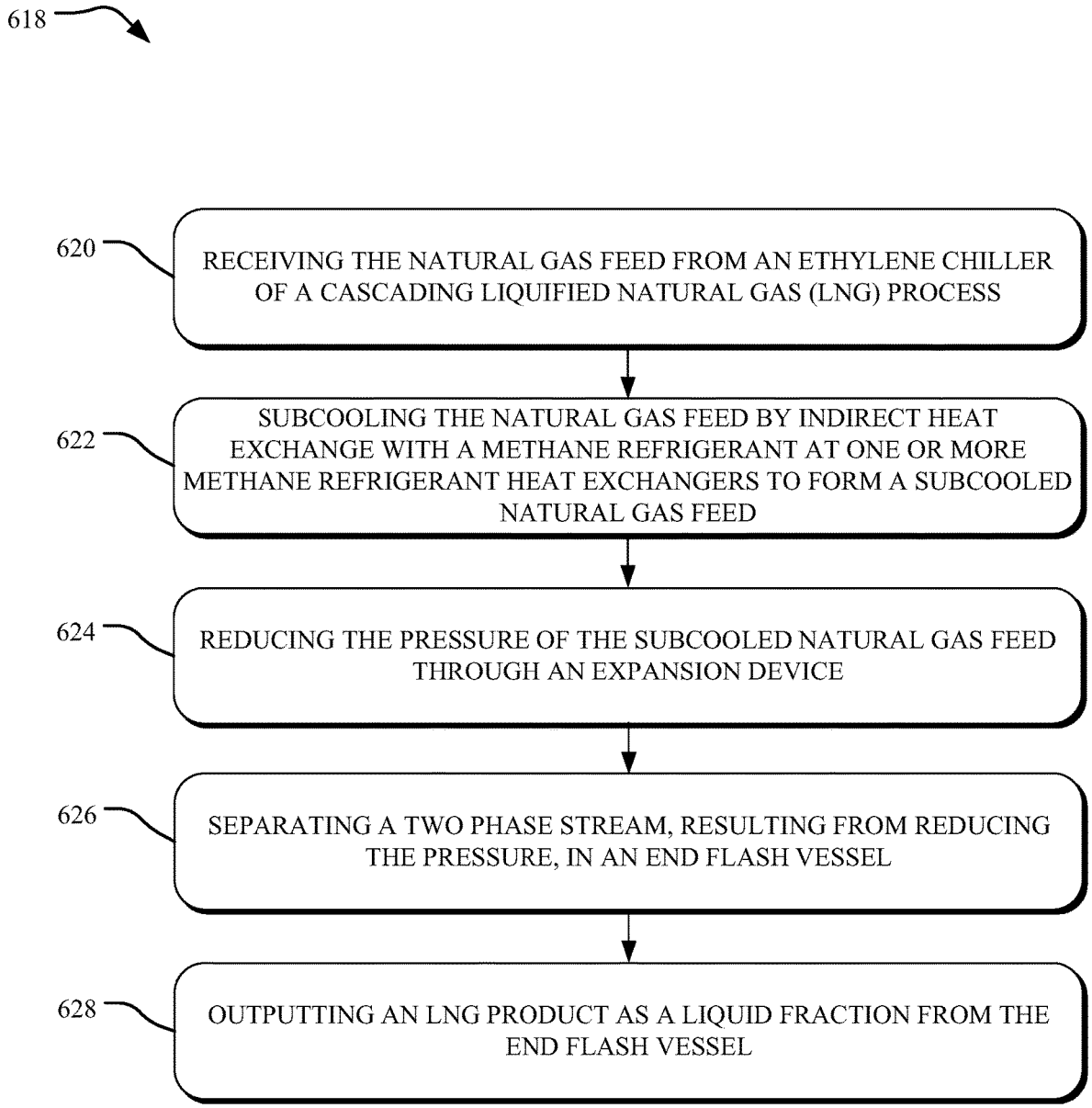
FIG. 4 illustrates an example method including operations for cooling a high nitrogen feed gas with a closed loop methane refrigeration cycle, which can be performed by the LNG production system depicted in FIG. 1.
Figure 5:
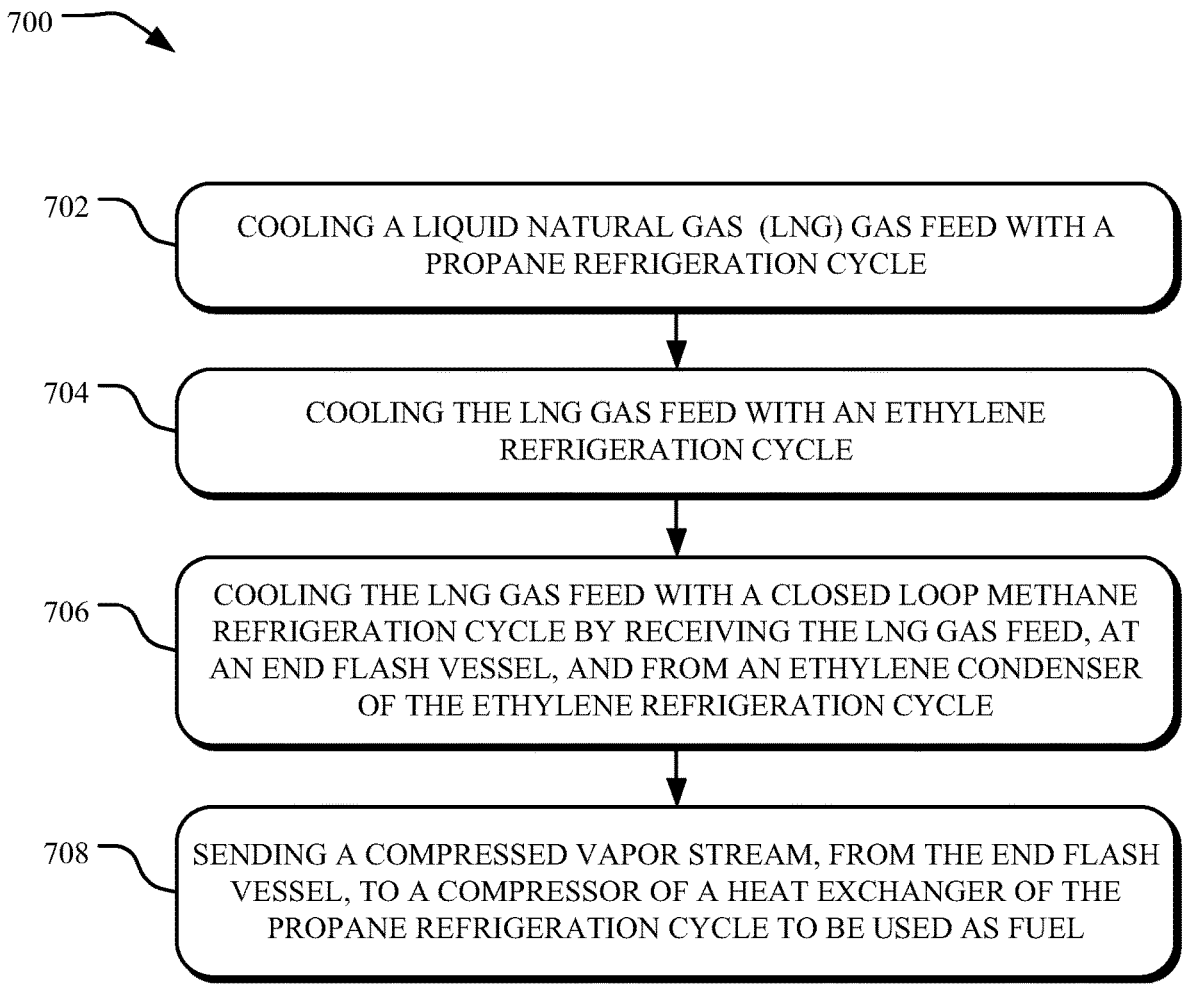
FIG. 5 illustrates an example method including operations for using a closed loop methane refrigeration cycle in a cascade refrigeration process, which can be performed by the LNG production system depicted in FIG. 1.

To begin a detailed description of an example cascade LNG facility 100 in accordance with the implementations described herein, reference is made to FIG. 1. The LNG facility 100 generally comprises a first refrigeration cycle 30 (e.g., a propane refrigeration cycle), a second refrigeration cycle 50 (e.g., an ethylene refrigeration cycle), and a third refrigeration cycle 70 (e.g., a methane refrigeration cycle). FIG. 2 illustrates an example LNG production system 400 with a closed loop methane refrigeration cycle and without NRU that may be integrated with or deployed in connection with an LNG producing facility, such as the LNG facility 100 depicted in FIG. 1. FIG. 3 illustrates an example LNG production system 400 with a closed loop methane refrigeration cycle and with NRU that may be integrated with or deployed in connection with an LNG producing facility, such as the LNG facility 100 depicted in FIG. 1. FIGS. 4 and 5 illustrate example methods that can be performed by the systems illustrated in FIGS. 1-3. Those skilled in the art will recognize that FIGS. 1-3 are schematics only and, therefore, various equipment, apparatuses, or systems that would be needed in a commercial plant for successful operation have been omitted for clarity. Such components might include, for example, compressor controls, flow and level measurements and corresponding controllers, temperature and pressure controls, pumps, motors, filters, additional heat exchangers, valves, and/or the like. Those skilled in the art will recognize such components and how they are integrated into the systems and methods disclosed herein.

In one implementation, the main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. While "propane," "ethylene," and "methane" are used to refer to respective first, second, and third refrigerants, it should be understood that these are examples only, and the presently disclosed technology may involve any combination of suitable refrigerants.

In some implementations, operation of the LNG facility 100 begins with the propane refrigeration cycle 30. Propane is compressed in a multi-stage (e.g., three-stage) propane compressor 31 driven by, for example, a gas turbine driver (not illustrated). The stages of compression may exist in a single unit or a plurality of separate units mechanically coupled to a single driver. Upon compression, the propane is passed through a conduit 300 to a propane cooler 32 where the propane is cooled and liquefied through indirect heat exchange with an external fluid (e.g., air or water). A portion of the stream from the propane cooler 32 can then be passed through conduits 302 and 302A to a pressure reduction system 36A, for example, an expansion valve, as illustrated in FIG. 1. At the pressure reduction system 36A, the pressure of the liquefied propane is reduced, thereby evaporating or flashing a portion of the liquefied propane. A resulting two-phase stream then flows through a conduit 304A into a high-stage propane chiller 33A, which cools the natural gas stream in indirect heat exchange 38. A high stage propane chiller 33A uses the flashed propane refrigerant to cool the incoming natural gas stream in a conduit 110. Another portion of the stream from the propane cooler 32 is routed through a conduit 302B to another pressure reduction system 36B, illustrated, for example, in FIG. 1 as an expansion valve. At the pressure reduction system 36B, the pressure of the liquefied propane is reduced in a stream 304B.

The cooled natural gas stream from the high-stage propane chiller 33A flows through a conduit 114 to a separation vessel or vessels. At the separation vessel or vessels, water and in some cases a portion of the propane and/or heavier components are removed. In some cases, where removal is not completed in upstream processing, a treatment system 40 may follow the separation vessels. The treatment system 40 removes moisture, mercury and mercury compounds, particulates, and other contaminants to create a treated stream. The stream exits the treatment system 40 through a conduit 116. The stream 116 then enters the intermediate-stage propane chiller 34. At the intermediate-stage propane chiller 34, the stream is cooled in indirect heat exchange 41 via indirect heat exchange with a propane refrigerant stream. The resulting cooled stream output into a conduit 118 is routed to the low-stage propane chiller 35, where the stream can be further cooled through indirect heat exchange means 42. The resultant cooled stream exits the low-stage propane chiller 35 through a conduit 120. Subsequently, the cooled stream in the conduit 120 is routed to the high-stage ethylene chiller 53.

A vaporized propane refrigerant stream exiting the high-stage propane chillers 33A and 33B is returned to a high-stage inlet port of the propane compressor 31 through a conduit 306. An un-vaporized propane refrigerant stream exits the high-stage propane chiller 33B via a conduit 308 and is flashed via a pressure reduction system 43, illustrated in FIG. 1 as an expansion valve, for example. The liquid propane refrigerant in the high-stage propane chiller 33A provides refrigeration duty for the natural gas stream. A two-phase refrigerant stream enters the intermediate-stage propane chiller 34 through a conduit 310, thereby providing coolant for the natural gas stream (in conduit 116) and the stream entering the intermediate-stage propane chiller 34 through a conduit 204. The vaporized portion of the propane refrigerant exits the intermediate-stage propane chiller 34 through a conduit 312 and enters an intermediate-stage inlet port of the propane compressor 31. The liquefied portion of the propane refrigerant exits the intermediate-stage propane chiller 34 through a conduit 314 and is passed through a pressure-reduction system 44, for example an expansion valve, whereupon the pressure of the liquefied propane refrigerant is reduced to flash or vaporize a portion of the liquefied propane. The resulting vapor-liquid refrigerant stream is routed to the low-stage propane chiller 35 through a conduit 316. At the low-stage propane chiller 35, the refrigerant stream cools the methane-rich stream and an ethylene refrigerant stream entering the low-stage propane chiller 35 through the conduits 118 and 206, respectively. The vaporized propane refrigerant stream exits the low-stage propane chiller 35 and is routed to a low-stage inlet port of the propane compressor 31 through a conduit 318. The vaporized propane refrigerant stream is compressed and recycled at the propane compressor 31 as previously described.

In one implementation, a stream of ethylene refrigerant in a conduit 202 enters the high-stage propane chiller 33B. At the high-stage propane chiller 33B, the ethylene stream is cooled through indirect heat exchange 39. The resulting cooled ethylene stream is routed in the conduit 204 from the high-stage propane chiller 33B to the intermediate-stage propane chiller 34. Upon entering the intermediate-stage propane chiller 34, the ethylene refrigerant stream may be further cooled through indirect heat exchange 45 in the intermediate-stage propane chiller 34. The resulting cooled ethylene stream exits the intermediate-stage propane chiller 34 and is routed through a conduit 206 to enter the low-stage propane chiller 35. In the low-stage propane chiller 35, the ethylene refrigerant stream is at least partially condensed, or condensed in its entirety, through indirect heat exchange 46. The resulting stream exits the low-stage propane chiller 35 through a conduit 208 and may be routed to a separation vessel 47. At the separation vessel 47, a vapor portion of the stream, if present, is removed through a conduit 210, while a liquid portion of the ethylene refrigerant stream exits the separator 47 through a conduit 212. The liquid portion of the ethylene refrigerant stream exiting the separator 47 may have a representative temperature and pressure of about −24° F. (about −31° C.) and about 285 psi (about 1,965 kPa). However, other temperatures and pressures are contemplated.

Turning now to the ethylene refrigeration cycle 50 in the LNG facility 100, in one implementation, the liquefied ethylene refrigerant stream in the conduit 212 enters an ethylene economizer 56, and the stream is further cooled by an indirect heat exchange 57 at the ethylene economizer 56. The resulting cooled liquid ethylene stream is output into a conduit 214 and routed through a pressure reduction system 58, such as an expansion valve. The pressure reduction system 58 reduces the pressure of the cooled predominantly liquid ethylene stream to flash or vaporize a portion of the stream. The cooled, two-phase stream in a conduit 215 enters the high-stage ethylene chiller 53. In the high-stage ethylene chiller 53, at least a portion of the ethylene refrigerant stream vaporizes to further cool the stream in the conduit 120 entering an indirect heat exchange 59. The vaporized and remaining liquefied ethylene refrigerant exits the high-stage ethylene chiller 53 through conduits 216 and 220, respectively. The vaporized ethylene refrigerant in the conduit 216 may re-enter the ethylene economizer 56, and the ethylene economizer 56 warms the stream through an indirect heat exchange 60 prior to entering a high-stage inlet port of the ethylene compressor 51 through a conduit 218. Ethylene is compressed in multi-stages (e.g., two-stage) at the ethylene compressor 51 driven by, for example, a gas turbine driver (not illustrated). The stages of compression may exist in a single unit or a plurality of separate units mechanically coupled to a single driver.

The cooled stream in the conduit 120 exiting the low-stage propane chiller 35 is routed to the high-stage ethylene chiller 53, where it is cooled via the indirect heat exchange 59 of the high-stage ethylene chiller 53. The remaining liquefied ethylene refrigerant exiting the high-stage ethylene chiller 53 in a conduit 220 may re-enter the ethylene economizer 56 and undergo further sub-cooling by an indirect heat exchange 61 in the ethylene economizer 56. The resulting sub-cooled refrigerant stream exits the ethylene economizer 56 through a conduit 222 and passes a pressure reduction system 62, such as an expansion valve, whereupon the pressure of the refrigerant stream is reduced to vaporize or flash a portion of the refrigerant stream. The resulting, cooled two-phase stream in a conduit 224 enters the low-stage ethylene chiller/condenser 55.

A portion of the cooled natural gas stream exiting the high-stage ethylene chiller 53 is routed through conduit a 122 to enter an indirect heat exchange 63 of the low-stage ethylene chiller/condenser 55. In the low-stage ethylene chiller/condenser 55, the cooled stream is at least partially condensed and, often, subcooled through indirect heat exchange with the ethylene refrigerant entering the low-stage ethylene chiller/condenser 55 through the conduit 224. The vaporized ethylene refrigerant exits the low-stage ethylene chiller/condenser 55 through a conduit 226, which then enters the ethylene economizer 56. In the ethylene economizer 56, vaporized ethylene refrigerant stream is warmed through an indirect heat exchange 64 prior to being fed into a low-stage inlet port of the ethylene compressor 51 through a conduit 230. As shown in FIG. 1, a stream of compressed ethylene refrigerant exits the ethylene compressor 51 through a conduit 236 and subsequently enters the ethylene cooler 52. At the ethylene cooler 52, the compressed ethylene stream is cooled through indirect heat exchange with an external fluid (e.g., water or air). The resulting cooled ethylene stream may be introduced through the conduit 202 into high-stage propane chiller 33B for additional cooling, as previously described.

The condensed and, often, sub-cooled liquid natural gas stream exiting the low-stage ethylene chiller/condenser 55 in a conduit 124 can also be referred to as a "pressurized LNG-bearing stream." This pressurized LNG-bearing stream exits the low-stage ethylene chiller/condenser 55 through the conduit 124 prior to entering a main methane economizer 73. In the main methane economizer 73, methane-rich stream in the conduit 124 may be further cooled in an indirect heat exchange 75 through indirect heat exchange with one or more methane refrigerant streams (e.g., 76, 77, 78, 79). The cooled, pressurized LNG-bearing stream exits the main methane economizer 73 through a conduit (e.g., as a high nitrogen gas feed 134) and is routed to the section 400 of the methane refrigeration cycle 70. In the section 400, the pressurized LNG-bearing stream is further subcooled through indirect heat exchange with the methane refrigerant The liquid feed can be routed to the closed loop methane refrigeration cycle 400 discussed below via conduits 134, 136, 142, 150, or 160.

In some cases, the natural gas feed from the low-stage ethylene chiller/condenser 55 can be a high nitrogen natural gas feed or a medium nitrogen natural gas feed. For instance, LNG facility 100 can operate the methane refrigerant system in a closed loop (e.g., closed loop methane refrigeration cycle 400 discussed below regarding FIGS. 2 and 3), as the final refrigeration cycle for liquefying natural gas. Rather than recombining methane recycle back with the natural gas feed further downstream, the closed loop methane refrigeration cycle keeps the methane refrigerant separate from the natural gas feed throughout the methane refrigeration cooling cycle. This improves process efficiency, especially for processing medium or high nitrogen feed gas, because these techniques can eliminate the need of a nitrogen removal unit (NRU), or NRU components, when the nitrogen content in the feed gas is up to 2.5% molarity. High nitrogen feed gas (e.g., with nitrogen content greater than 2.5% molarity) can also be subcooled using these techniques with a reduced-size NRU (e.g., using a single NRU removal column).

Turning to FIG. 2, an example LNG production system 400 can include a closed loop methane refrigeration cycle 400 for cooling the natural gas feed, which can form at least a portion of the LNG facility 100 depicted in FIG. 1.

In some examples, the natural gas feed can be a medium nitrogen gas feed or a high nitrogen gas feed 134. The high nitrogen natural gas feed 134 can be received at the subcooler 506, for instance, from the low-stage ethylene chiller/condenser 55 and through the conduit 134 and/or one or more additional conduit(s). The high nitrogen natural gas feed 134 can be subcooled in the high stage LNG subcooler 506, the intermediate stage LNG subcooler 508 and the low stage LNG subcooler 510 by indirect heat exchange with methane refrigerant. Using the one or more expansion components 526, 528, 530, methane refrigerant 136 can be expanded to high pressure (HP), medium pressure (MP), and/or low pressure (LP) pressure levels to provide refrigeration for the last sub-cooling steps for the natural gas feed via passage through one or more heat exchangers 506, 508, and 510. The high nitrogen natural gas feed 516 can be expanded through a valve or expander 518 to a pressure slightly higher than ambient pressure and the resulting two phase stream 520 is separated at the end flash vessel 406. A vapor steam 412 can be outputted from the end flash vessel 406 and can provide cooling to the high pressure end flash gas 542 in the exchanger 544. The warmed stream 532 from the exchanger 544 can be compressed by the compressor 534. Part of the compressed end flash gas can be used as fuel. The liquid fraction from the end flash vessel 406 can comprise an output of liquid natural gas feed product 416.

Furthermore, the rest of compressed end flash gas 542 discharged from the compressor 534 can be condensed in the exchanger 544. Condensed stream from the exchanger 544 can be sent to the end flash vessel 406. In this closed loop methane refrigeration cycle 400, the natural gas feed (e.g., the high nitrogen natural gas feed 404) is not combined with the methane refrigerant. Accordingly accumulation of nitrogen in the high nitrogen feed gas can be eliminated and the corresponding refrigerant compression power reduced.

Furthermore, the closed loop methane refrigeration cycle 400 can process the feed gas with medium and/or high nitrogen content while omitting at least some of an NRU (e.g., one or more NRU columns, reflux drums, expansion valves, etc.). For the high nitrogen feed gas, a smaller nitrogen unit may be used. In some examples, the methane refrigerant for the closed loop methane refrigeration cycle 400 is supplied from feed gas or high purity methane from a nitrogen removal column bottom. In some examples, the heating/cooling components of the closed loop methane refrigeration cycle 400 can be core-in-shell exchangers which use high purity methane as a closed loop refrigerant. Additionally or alternatively, brazen aluminum heat exchangers (BAHX) may be used to handle two phase streams when feed gas containing heavy components are used as the closed loop refrigerant.

In examples that use an open loop system instead of the closed loop methane refrigeration cycle 400, the process efficiency can decrease because the nitrogen content increases in the feed gas. This results in the decrease in LNG production for the selected gas turbines. The closed loop methane refrigeration cycle 400, in contrast, can prevent the nitrogen content in the methane loop from increasing. Nevertheless, if the nitrogen content in feed gas is higher than 2.5 mole %, the closed loop methane refrigeration cycle 400 can still use NRU to remove nitrogen to meet LNG product specification (e.g., depicted in FIG. 3). For instance, a single NRU column with a reboiler and/or a condenser may be used in such scenarios.

In some examples, one or more controller(s) can access operating parameters stored on memory storage devices to implement the operations discussed herein. The operating parameters can include instructions for actuating one or more switches and/or valves to direct the natural feed gas and methane refrigerant, as discussed herein. For instance, a first portion of the methane refrigeration cycle 70 can include the closed loop methane refrigeration cycle 400 without a NRU and a second portion of the methane refrigeration cycle 70 can include one or more NRU components. The controller(s) can direct a high nitrogen natural gas feed to the second portion and/or direct a medium nitrogen natural gas feed to the first portion in response to one or more nitrogen measurements of the natural gas feed.

FIG. 3 illustrates the example LNG production system 400 including a closed loop methane refrigeration cycle with nitrogen removal. The system 400 can cool a high nitrogen natural gas feed with the closed loop methane refrigeration cycle 400 using a variety of cooling and/or nitrogen removal components 600. The LNG production system 400 depicted in FIG. 3 can form at least a portion of the LNG facility 100 depicted in FIG. 1.

The closed loop methane refrigeration cycle depicted in FIG. 3 can receive an LNG feed (e.g., the high nitrogen natural gas feed 134) at the subcooler 506, for instance, from an ethylene feed gas condenser. The high nitrogen natural gas feed 134 can be subcooled in the high stage LNG subcooler 506, the intermediate stage LNG subcooler 508 and the low stage LNG subcooler 510 by indirect heat exchange with methane refrigerant. The high nitrogen natural gas feed 134 can be outputted from the low stage LNG subcooler 510 to the nitrogen removal components 600. One or more of these nitrogen removal components 600 (e.g., 602-616) can be used to remove nitrogen from the high nitrogen natural gas feed 134.

After processing the feed gas with these cooling and/or nitrogen removal components 600, the closed loop methane refrigeration cycle can output the LNG feed 524 as a liquid faction from the end flash vessel 406 (e.g., the liquid natural gas feed product 416) to a heat exchanger as fuel gas. Moreover, the nitrogen removal components 600 can include one or more level controllers (LC) s, pressure controllers (PC) s, and/or expansion/release valves for performing the operations discussed herein.

FIG. 4 illustrates an example method 618 including operations for cooling a high nitrogen feed gas with a closed loop methane refrigeration cycle, which can be performed by the LNG production system(s) depicted in FIGS. 1-3.

At operation 620, the method 618 can receive the natural gas feed from an ethylene chiller of a cascading liquified natural gas (LNG) process. At operation 622, the method 618 can subcool the natural gas feed by indirect heat exchange with a methane refrigerant at one or more methane refrigerant heat exchangers to form a subcooled natural gas feed. At operation 624, the method 618 can reduce a pressure of the subcooled natural gas feed through an expansion device. At operation 626, the method 618 can separate a two phase stream, resulting from reducing the pressure, in an end flash vessel. At operation 628, the method 618 can output an LNG product as a liquid fraction from the end flash vessel FIG. 5 illustrates an example method 700 for using a closed loop methane refrigeration cycle in a cascade refrigeration process, which can be performed by the LNG production system(s) depicted in FIGS. 1-3.

At operation 702, the method 700 can cool an LNG gas feed with a propane refrigeration cycle. At operation 704, the method 700 can cool the LNG gas feed with an ethylene refrigeration cycle. At operation 706, the method 700 can cool the LNG gas feed with a closed loop methane refrigeration cycle by receiving the LNG gas feed, at an end flash vessel, and from an ethylene condenser of the ethylene refrigeration cycle. At operation 708, the method 700 can send a compressed vapor stream, from the end flash vessel, to fuel gas system.

Any of the steps depicted in FIGS. 4 and 5 and throughout this disclosure can be rearranged while remaining within the disclosed subject matter. For instance, any of the steps depicted in FIGS. 4 and 5 and throughout this disclosure may be omitted, repeated, performed in parallel, performed in a different order, and/or combined with any other of the steps depicted in FIGS. 4 and 5 and throughout this disclosure.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A method for cooling a natural gas feed, the method comprising:

receiving the natural gas feed from an ethylene chiller of a liquified natural gas (LNG) process;

condensing a methane refrigerant discharge in an ethylene heat exchanger to form a condensed methane refrigerant that is routed to one or more methane refrigerant heat exchangers;

subcooling the natural gas feed by indirect heat exchange with the condensed methane refrigerant at the one or more methane refrigerant heat exchangers of a closed-loop refrigeration cycle to form a subcooled natural gas feed, wherein the condensed methane refrigerant is kept separate from the natural gas feed;

reducing a pressure of the subcooled natural gas feed;

separating a two phase stream, resulting from reducing the pressure, in an end flash vessel; and outputting an LNG product as a liquid fraction from the end flash vessel, wherein nitrogen is removed from the natural gas feed without utilizing a nitrogen rejection unit.

2. The method of claim 1, wherein the natural gas feed has a nitrogen content greater than 1.0 percent molarity and less than 2.5 percent molarity.

3. The method of claim 1, further comprising expanding the methane refrigerant discharge to a lower pressure prior to cooling the LNG product with the methane refrigerant discharge.

4. The method of claim 1, wherein the ethylene heat exchanger is a core-in-shell heat exchanger.

5. The method of claim 1, wherein cooling the LNG product with the one or more methane refrigerant heat exchangers is a sub-cooling step of the LNG process.

6. The method of claim 1, wherein cooling the LNG product with the methane refrigerant discharge omits a nitrogen removal unit downstream from the ethylene chiller.

7. The method of claim 1, further comprising compressing a vapor stream from the end flash vessel to form a compressed vapor stream.

8. The method of claim 7, further comprising sending part of compressed vapor stream from the closed loop methane refrigeration cycle to be used as fuel.

9. The method of claim 1, wherein the ethylene chiller is a core-in-shell heat exchanger.

10. The method of claim 1, wherein the one or more methane refrigerant heat exchangers includes a core-in-shell heat exchanger.

* * * * *